US007083703B2

(12) United States Patent
Aho et al.

(10) Patent No.: US 7,083,703 B2
(45) Date of Patent: Aug. 1, 2006

(54) FILLER AND A PROCESS FOR THE PRODUCTION THEREOF

(75) Inventors: Outi Aho, Helsinki (FI); Petri Silenius, Lohja as. (FI); Maija Pitkänen, Jyväskylä (FI); Soili Hietanen, Espoo (FI)

(73) Assignee: M-real Oyj, Espoo (FI)

( * ) Notice: Subject to any disclaimer, the term of this patent is extended or adjusted under 35 U.S.C. 154(b) by 257 days.

(21) Appl. No.: 10/475,299

(22) PCT Filed: Apr. 24, 2002

(86) PCT No.: PCT/FI02/00343

§ 371 (c)(1),
(2), (4) Date: Oct. 21, 2003

(87) PCT Pub. No.: WO02/086238

PCT Pub. Date: Oct. 31, 2002

(65) Prior Publication Data

US 2004/0131854 A1 Jul. 8, 2004

(30) Foreign Application Priority Data

Apr. 24, 2001 (FI) ..... 20010849

(51) Int. Cl.
*D21H 17/69* (2006.01)
*D21H 17/70* (2006.01)

(52) U.S. Cl. ..... 162/9; 162/149; 162/181.1; 162/181.2; 162/182; 162/189; 106/136.1; 106/137.1; 106/140.1; 106/139.1; 106/407; 106/501.1; 106/823

(58) Field of Classification Search ..... 162/9, 162/149, 181.1, 182, 181.2, 189; 106/136.1, 106/137.1, 140.1, 139.1, 407, 501.1, 823
See application file for complete search history.

(56) References Cited

U.S. PATENT DOCUMENTS

| | | | | |
|---|---|---|---|---|
| 5,223,090 | A | 6/1993 | Klungness et al. | 162/9 |
| 5,824,364 | A | 10/1998 | Cousin et al. | 427/212 |
| 5,830,364 | A * | 11/1998 | Bleakley | 210/712 |

FOREIGN PATENT DOCUMENTS

| | | | |
|---|---|---|---|
| DE | 2 240 396 | A | 3/1974 |
| EP | 0 791 685 | A2 | 8/1997 |
| EP | 0 930 345 | A2 | 7/1999 |
| WO | 96/36750 | A1 | 11/1996 |
| WO | 97/01670 | A1 | 1/1997 |
| WO | 99/57370 | A1 | 11/1999 |

* cited by examiner

*Primary Examiner*—Peter Chin
(74) *Attorney, Agent, or Firm*—Kubovcik & Kubovcik

(57) ABSTRACT

A filler comprising cellulose or lignocellulose fibrils on which light-scattering material particles have been deposited, and a process for the manufacture thereof. In the filler according to the invention, an alkyl derivative of cellulose, such as CMC, has been sorbed to the fibrils. Such a filler can be prepared from a source material containing cellulose or lignocellulose fibrils by first forming a fibril suspension, into which there are fed source materials forming an inorganic or organic salt that, when precipitating, forms a light-scattering pigment. The filler according to the invention has very good strength properties; in particular, good bond strength is achieved by means of it. The concentration of mineral pigment in paper can be increased and, furthermore, the grammage of paper can be lowered without the other important properties of the paper deteriorating.

20 Claims, 2 Drawing Sheets

FILLER AND A PROCESS FOR THE PRODUCTION THEREOF

Figure 1:
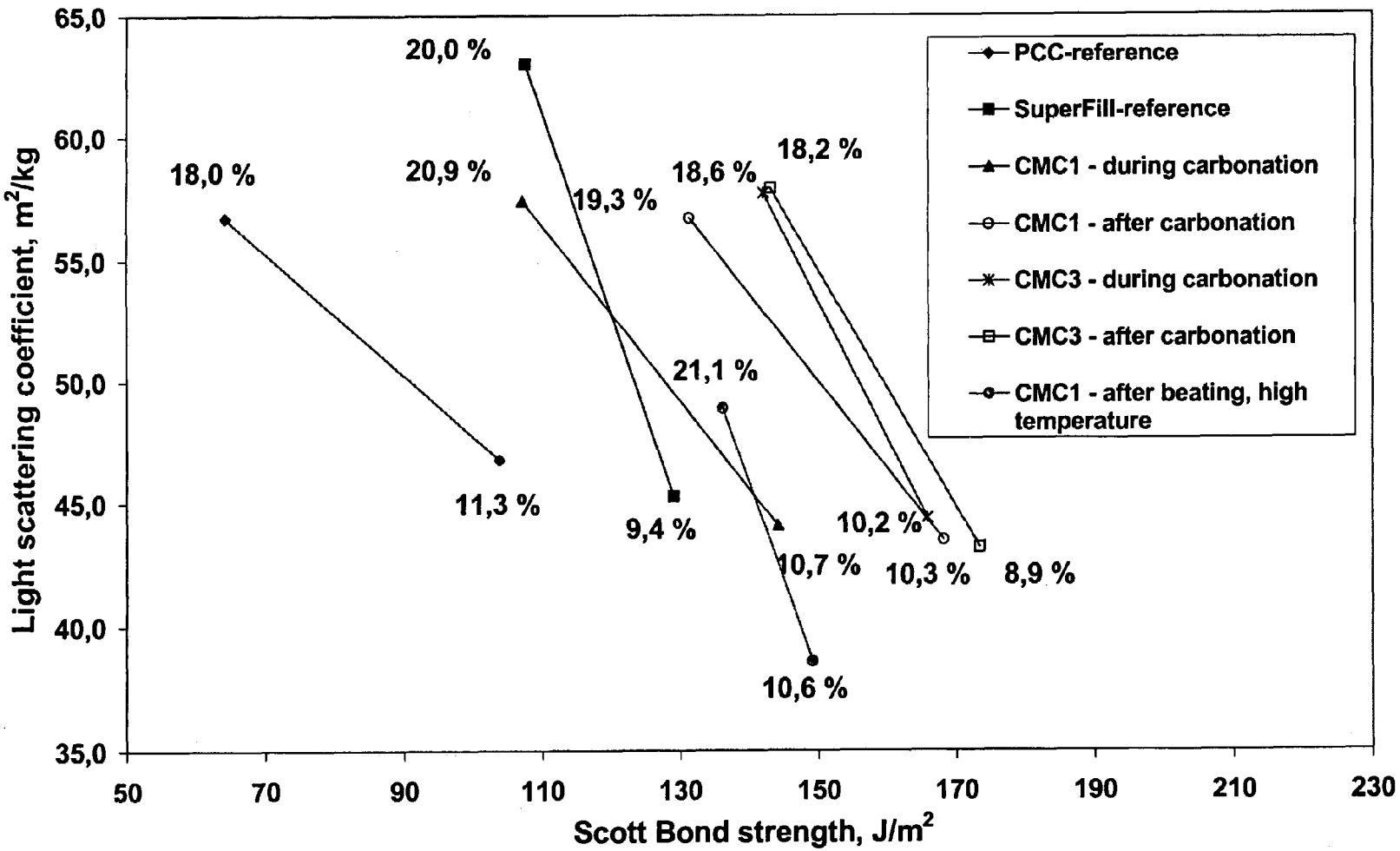

The present invention relates to a filler according to the preamble of claim 1.

A filler such as this comprises fibrils of cellulose or lignocellulose, on which there are deposited light-scattering material particles.

The invention also relates to the process according to the preamble of claim 10 for the manufacture of the filler.

FI Patent Specification No. 100729 anticipates a filler for use in papermaking, the filler comprising porous aggregates formed from calcium carbonate particles deposited on the surface of fines. This filler of a novel type is characterized in that the fines are made up of fine fibrils prepared by beating from cellulose fibers and/or mechanical pulp fibers. The size distribution of the fines fraction in the main corresponds to wire screen fraction P100.

On the basis of the said patent publication, the said filler of a novel type improves the strength properties of paper and the concentration of calcium carbonate in the paper can be increased, whereby the grammage of the paper can be lowered without changing the other important properties of the paper. By the use of the filler an excellent combination of light scattering and strength properties is accomplished in comparison with commercial PCC grades.

Associated with fines-based fillers there is generally the problem that, when the filler content increases, the strength of the paper or cardboard prepared from the pulp decreases. The same phenomenon also appears with other fillers.

It is an object of the present invention to eliminate the disadvantages associated with the state of the art and to provide a filler of a novel type, having improved strength, while the excellent light scattering efficiency of the above-mentioned filler is maintained.

The invention is based on the idea that the strength of a fibril-based filler is increased by the sorption of carboxymethyl cellulose (CMC) or a similar alkyl derivative of cellulose into the fines.

According to the present invention it has now been observed, unexpectedly, that an alkyl derivative of cellulose can be sorbed into fines without affecting the crystalline or granular form of the calcium carbonate. It has further been observed in the invention that it is possible to use as the filler also other fillers at least partly made up of cellulose or lignocellulose fibrils, with light-scattering material particles deposited on them. These particles are typically inorganic or organic salts precipitating in an aqueous phase, such as calcium sulfate, barium sulfate and calcium oxalate.

More specifically, the filler according to the invention is mainly characterized by what is stated in the characterizing part of claim 1.

The process according to the invention is characterized in what is stated in the characterizing part of claim 10.

The invention provides considerable advantages. Thus, strength properties better than those achieved with the filler according to the FI Patent mentioned above are achieved with the novel filler; in particular the bond strength increases. In general, the light-scattering level rises when the filler content increases. Since a good strength of paper is achieved with the novel filler, the concentration of the mineral pigment (e.g. $CaCO_3$) in the paper can be increased and further the grammage of the paper can be lowered without the other important properties of the paper deteriorating. Thus, the light-scattering level can be raised, and at the same time savings of cost are achieved owing to the lower fiber quantity. The novel filler also has very good retention. Since filler retention is better than previously, the use of retention agents can be reduced and also thereby significant savings can be achieved in the costs of paper making.

The invention will be described below in greater detail with the help of a detailed description and some working examples.

FIG. 1 shows the light-scattering efficiency of filler sheets as a function of bond strength when CMC is added at a high temperature during or after carbonation (CMC1:DS 0.2, 0.4 M NaOH; CMC3: DS 0.5 dissolved in pure water, pH 8)

Figure 2:
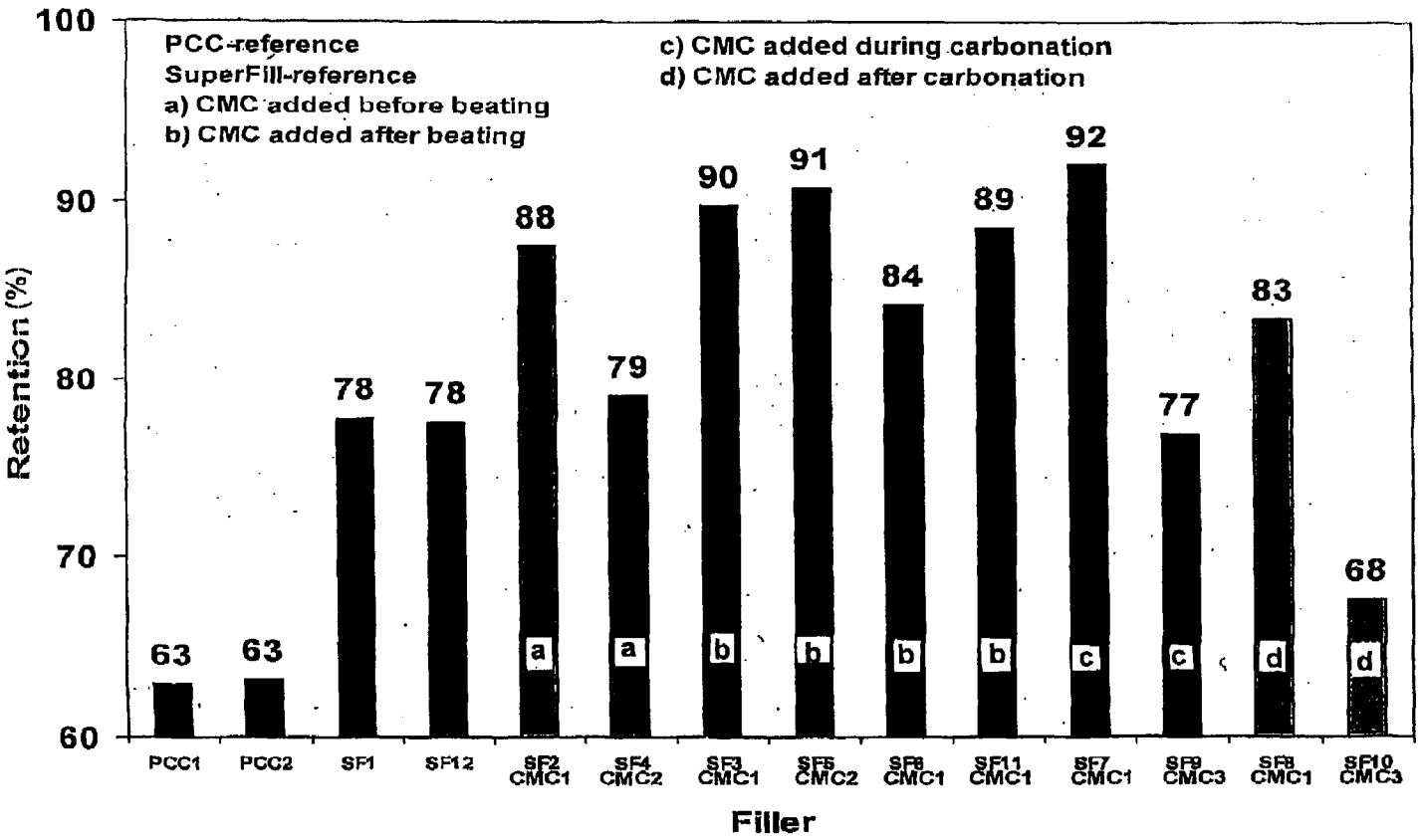

FIG. 2 shows the filler retention (CMC1: DS 0.2, 0.4 M NaOH; CMC2: DS 0.5, 0.5 M NaOH; CMC3: DS 0.5 dissolved in pure water, pH 8)

The invention is illustrated by using carboxymethyl cellulose and its sorption into cellulose or lignocellulose fibrils as an example. Even though CMC is an especially preferred embodiment, it is to be emphasized in this context that the principles described in the invention can also be applied to other cellulose derivatives similar with respect to the attaching, such as methyl cellulose, hydroxyethyl cellulose and hydroxypropyl cellulose, by means of which the properties of fibrils can be modified with respect to, for example, strength and/or water absorption.

In the examples presented below, the solution according to the invention is used for the modification of fibrils obtained from a chemical pulp. By "chemical pulp" is meant in this context a pulp which has been treated with digestion chemicals for the delignification of the cellulose fibers. According to one preferred embodiment, the invention is applied to fibrils obtained by beating from pulps prepared by the sulfate process and by other alkaline processes. In addition to chemical pulps, the invention is also suitable for the modification of fibrils obtained from chemimechanical and mechanical pulps.

Typically the average thickness of cellulose or lignocellulose fibrils is smaller than 1 μm. The fibrils are characterized by at least one of the following criteria:

a. they correspond to a fraction which passes a 50-mesh screen;
b. their average thickness is 0.01–10 μm (preferably at maximum 5 μm and especially preferably at maximum 1 μm) and their average length is 10–1500 μm.

The source material for the fibrils, i.e. fines based on cellulose or other fibers, is fibrillated by beating it in a pulp refiner. The desired fraction may, when necessary, be separated by using a screen, but fines need not always be screened. Suitable fibril fractions include wire screen fractions P50–P400 (preferably at least approx. 55% of these). Preferably refiners with grooved blades are used.

The light-scattering material particles in the filler are inorganic or organic salts that can be formed from their source materials by precipitation in an aqueous medium. Such compounds include calcium carbonate, calcium oxalate, calcium sulfate, barium sulfate, and mixtures thereof. The material particles are deposited on the fibrils. The amount of an inorganic salt compound in proportion to the fibril amount is approx. 0.0001–95% by weight, preferably approx. 0.1–90% by weight, most suitably approx. 60–80% by weight, calculated from the amount of filler, and approx. 0.1–80% by weight, preferably approx. 0.5–50% by weight, of the paper. Calcium carbonate is most preferably obtained from calcium hydroxide and a material which produces carbonate ions in the aqueous phase, such as an alkali metal carbonate or carbon dioxide; calcium oxalate is obtained from oxalic acid and a soluble calcium salt; and calcium and barium sulfates are obtained from a soluble calcium salt or respectively barium salt and a suitable sulfate compound such as an alkali metal sulfate or ammonium sulfate.

The invention is discussed below in particular on the basis of a modification of the product according to FI Patent Specification No. 100729, but it is clear that the invention may just as well be applied to other above-mentioned products based on fines.

The filler is prepared by depositing a mineral pigment on the surface of fine fibrils prepared from cellulose fibers and/or mechanical pulp fibers. For example the precipitation of calcium carbonate can be carried out by feeding into an aqueous slush of fibrils an aqueous calcium hydroxide solution which possibly contains a solid calcium hydroxide, and a compound which contains carbonate ions and is at least partly dissolved in water (e.g. sodium carbonate or ammonium carbonate). It is also possible to introduce into the aqueous phase carbon dioxide gas that, in the presence of calcium hydroxide, produces calcium carbonate. There form string-of-pearls-like calcium carbonate crystal aggregates which are held together by fibrils, i.e. fine strands, and in which the calcium carbonate particles are deposited onto the fine fibrils and attached to them. The fine fibrils together with calcium carbonate form string-of-pearls-like strands, and the calcium carbonate aggregates primarily resemble strings of pearls in a pile. In water (slush) the ratio of the effective volume of the aggregates to the pulp is very high compared with the corresponding ratio of conventional calcium carbonate used as filler. By "effective volume" is meant in this case the volume required by the pigment.

The diameter of the calcium carbonate particles in the aggregates is approx. 0.1–5 μM, typically approx. 0.2–3 μm. At least 80%, preferably up to 90%, of the precipitated light-scattering pigment particles are attached to fibrils.

According to the present invention, a cellulose derivative, which is hereinafter illustrated with CMC, is contacted in liquid phase with fibrils, and the contacting of the fibrils and the cellulose derivative is continued until the cellulose derivative has attached to the fibrils (sorption), preferably so that it cannot be washed off from them. The attaching of CMC can be done simultaneously with the precipitation of the mineral pigment or after the precipitation. It is also possible to add the CMC before the precipitation. In that case the CMC is added either during beating or in a separate sorption after beating.

The following description mainly refers to the case in which the attachment of the CMC is performed on fibrils that already contain a mineral pigment (i.e. the term "fibril" also covers fibrils containing mineral pigments). It should be noted, however, that the addition of CMC was not found to disturb the precipitation of the mineral pigment when the CMC was added halfway through the precipitation. The pigment crystals or particles formed are similar in size and crystal form in both cases.

The cellulose derivative can be added as a solid directly to a slush containing fibrils, in which case the slush is subjected to effective dispersing to dissolve the CMC. However, it is preferable to carry out the contacting by first forming an aqueous or alkaline solution of CMC, which is mixed with a slush containing fiber material. Such a solution or suspension is homogenized at room temperature or an elevated temperature (<100° C.), the undissolved material may, when so desired, be separated by, for example, centrifugation or filtration, and the clear mother liquor is recovered and used for the sorption. However, the CMC solution need not be treated, for example, by centrifugation after homogenization; it is possible to use it directly after the dissolution.

Of the cellulose derivative in the sorption solution, at least 10% by weight, preferably at least 20%, in particularly at least 30%, and most suitably at least 50%, is dissolved in the water or the aqueous phase at the alkaline conditions of the sorption.

In the invention, the aim is to attach a substantial proportion of the CMC present in the aqueous or alkaline solution, so that at least 10% by weight, preferably at least 20% by weight, in particular at least 30% by weight and most suitably at least 40% by weight, of the CMC is sorbed from the solution to the fibrils. The fibrils thereupon contain CMC or a corresponding derivative typically approx. 0.1–30%, preferably approx. 0.5–20%, usually approx. 1–15%, of their weight. It is attached to the fibril surfaces and/or sorbed into the fibrils.

The degree of substitution of the CMC grade (number of substituted hydroxyl groups per anhydroglucose unit, hereinafter also abbreviated "DS") may vary within a wide range, typically approx. 0.1–1.2. In the most common CMC grades the degree of substitution varies between 0.45 and 1.0. Derivatives having a high degree of substitution are in general so well soluble in water that they can be dissolved in water without using a strong alkali. It is also possible to prepare the CMC used in the invention by first dissolving it in an alkali solution. Derivatives having a lower degree of substitution, i.e. CMC grades having a DS smaller than 0.5, can be dissolved in water mainly in alkaline conditions, by forming a water solution having a pH higher than 8, typically at least 10.

As will be evident from the results presented below, a very good combination of light scattering and strength properties can be arrived at by using a CMC grade having a substitution degree (DS) of 0.5, dissolved in water, at a pH of 8, the CMC being added during the precipitation or after the precipitation. According to an especially preferred embodiment there is therefore used a CMC having a DS of approx. 0.40–0.90, e.g. DS 0.45–0.55.

The molecular weight of CMC may vary widely. Typically its degree of polymerization (DP) is approx. 100–20,000, in particularly approx. 200–5,000. CMC having a low DP can be sorbed to fibrils in larger quantities, which may have an advantageous effect on, for example, the water absorption and degree of charge of the fibers.

The pH of the CMC mixture or solution is usually adjusted for CMC sorption at a value of 6–13, preferably 6–10, especially preferably at least a pH of 8. A suitable base or acid can be used for the adjusting of the pH. The alkali used is especially preferably a bicarbonate or carbonate of an alkali metal or an alkali metal hydroxide. The acid used is a mineral acid or an acid salt. Sulfuric acid and its acid salts, such as alum, are regarded as the most suitable acids, and sodium bicarbonate, sodium carbonate and sodium hydroxide as the most suitable alkalis.

The fibril suspension is mixed with the cellulose derivative for at least 1 min, preferably at least 5 min, especially preferably at least 10 min and most suitably 20 min, before the recovery of the filler. Mixing periods of even several hours (1–10 h) are possible if it is desired to reach a high degree of attachment. The temperature is not critical; in operations in non-pressurized conditions it is typically approx. 10–100° C., preferably approx. 20–80° C. As was pointed out above, the amount of the cellulose derivative is 0.1–30% by weight, preferably approx. 1–20% by weight, of the weight of the fibrils (without mineral pigments). In proportion to the amount of mineral pigments the amount of the cellulose derivative is typically approx. 0.01–50% by weight, preferably approx. 0.1–20% by weight, most suitably approx. 0.5–15% by weight.

Since cellulose or lignocellulose fibrils and CMC are both anionic, in which case they reject each other, it is easier to achieve the attachment by adding some cation to the fiber suspension. Typically in the sorption conditions the concentration of the sodium ion (or corresponding cation) should be over 0.01 M, preferably over 0.01 M and in particular over 0.1 M.

The cellulose fiber suspension used for the attaching may contain additives. Retention-promoting materials, such as sodium acetate, can be mentioned as specific examples.

The dry matter content of the fibril slush fed to the attachment is approx. 0.1–10%. The aqueous phase used for the slush is, for example, a clear filtrate of the circulation water of the paper machine.

The attaching of the cellulose derivative may be carried out as a batch or semi-batch process or a continuous process by arranging the retention time of the pulp so as to be sufficiently long in the process apparatus used. A continuous process is regarded as advantageous.

The sorption suspension can be used as such in papermaking. If separation of the filler is desired, it is usually not dried before papermaking; it is separated from the suspension by, for example, filtration or screening, and the moist product is used as such. It is, however, possible to direct the recovered product to a separate drying step.

The novel filler can be used in particular for the manufacture of paper with good wet strength.

The present invention will be described below in greater detail with the help of the following non-restrictive working examples.

EXAMPLE 1

Preparation of Filler

Beating of Pulp

The beatings of the fines in cases in which CMC was added before the depositing were carried out in KCL by using a Voith-Sulzer refiner. Dense birch blades and a cutting angle of 40° were used. The consistency in the beatings was 4.0%. The rotation velocity in the beatings was 2000 rpm and the flow rate was 100 l/min. In beatings containing CMC the specific edge load was set at a lower level than in mere pulp beatings. The table shows the conditions in the various beatings.

TABLE

Beating conditions in Voith-Sulzer beatings.

| Quantity measured | BotniaPlus Birch TCF | BotniaPlus Birch TCF and CMC (DS 0.2) | BotniaPlus Birch TCF and CMC (DS 0.5) | KemiBrite Birch ECF |
|---|---|---|---|---|
| Idling power, kW | 2.625 | 2.442 | 2.353 | 2.360 |
| SEL, Ws/km | 250 | 200 | 200 | 250 |
| SEC, kWh/t | 160 | 158 | 157 | 197 |
| Beating time, min | 19.2 | 21.5 | 22.1 | 23.5 |
| Beating temperature, ° C. | 54.0 | 49.5 | 51.6 | 50.6 |
| SR number | 92 | 89 | 89 | 93 |

In cases in which the CMC was added at a high temperature, during or after the precipitation, the fines were prepared by production-scale beating at the technology center of Valmet Mechanical Pulping Oy at Anjalankoski. The pulp then used was KemiBrite Birch ECF birch pulp. The beating was carried out using a low-consistency cone refiner Conflo JC-01. The blades used in the beating were of the type SF. The consistency in the beating was approx. 4%. The idling power was determined as being 50 kW. The rotation velocity in the beating was 1000 rpm and the flow rate was 1500 l/min. The targeted SR number 90 was achieved with 11 through-runs. The specific edge load in the beating was 500 Ws/km and the specific energy consumption was 330 kWh/t. The temperature in the beating was 59.6° C. Fiber length was determined as being 0.54 mm by Kajaani FS-200 apparatus.

Carbonation of Fiber Pulp

Carbonation was carried out in tap water in accordance with what is disclosed in FI patent publication 100729. The reaction volume was 2.01 and the consistency of the fines was 0.5%. The $CaCO_3$ concentrations in the fillers prepared were approx. 70%. The sizes of the PCC particles were of the same order of magnitude as in Example 1 of FI patent 100729.

EXAMPLE 2

Carboxymethyl cellulose was attached to the product prepared above in order to improve the strength of the product. In the sorptions, two CMC grades were used, their substitution degrees (DS) being 0.2 and 0.5. The CMC having a degree of substitution of 0.2 was commercial CMC Nymcel ZSB 10 and the CMC having a degree of substitution of 0.5 was a grade prepared on a pilot scale. Solutions with an NaOH concentration of 0.4 mol/l were prepared from the CMC grades. The higher substitution degree (DS 0.5) CMC was dissolvable in water. From the said CMC a solution was prepared by dissolving the CMC in water and by adjusting the pH to 8. Thus the use of a strong NaOH solution could be avoided and more neutral process conditions could be attained. The CMC was sorbed as a dose of 5% of the fines in the various steps of the process described in Example 1.

It was observed that the adding of CMC did not disturb the precipitation of calcium carbonate when it was added during or after the precipitation. The calcium carbonate crystal forms and crystal size class of the CMC-modified fibril-based filler were as desired. The crystals were of the scalenohedral form.

The potentials of CMC-containing fillers as paper fillers were investigated by making filler sheets. The calcium carbonate concentrations investigated were 10% and 20%. The CMC-modified fillers were compared with two reference fillers: commercial precipitated calcium carbonate PCC Albacar LO and the filler according to FI patent 100729, for which the product name SuperFill is used.

The results are shown in FIG. 1, which depicts the light scattering coefficient as a function of bond strength when CMC was added at a high temperature after beating, during precipitation or thereafter. CMC1-DS 0.2, 0.4 M NaOH; CMC3-DS 0.5, dissolved in water, pH 8.

As shown in FIG. 2, better retention was achieved with the CMC-modified filler than with the PCC reference. With most CMC-modified fillers, retention was even better than with the SuperFill reference.

An increase in the strength properties was achieved with the CMC-modified fillers as compared with the SuperFill reference. The best increases were achieved in bond strength. FIG. 1 shows the light scattering of filler sheets as a function of bond strength. The concentrations in the figure are calcium carbonate concentrations. The bond strength of the CMC-modified product increased significantly. The increase in tensile and burst indices as compared with the references was smaller.

With the novel CMC-containing fillers, light scattering levels somewhat lower than with the SuperFill reference were achieved in paper; however, they were of the same order of magnitude as the light scattering of the PCC reference. The best combinations of light scattering and strength properties were achieved with the higher substitution degree (DS 0.5) CMC grade dissolved in water, at pH 8, the CMC being added during or after the precipitation. The light scattering coefficients, tensile indices and bond strengths of the CMC-modified fillers concerned were mutually of the same order of magnitude.

In general the level of light scattering rises as the filler concentration increases. It can be concluded from the results that, since higher strengths were achieved in paper with a CMC-modified filler than with the SuperFill reference, with the help of the invention the $CaCO_3$ concentration in paper can be increased and further the grammage of the paper can be lowered without the other important properties of the paper deteriorating. Thus the level of light scattering can be raised and additionally savings in costs are achieved owing to the smaller amount of fiber.

What is claimed is:

1. A filler comprising cellulose or lignocellulose fibrils on which light-scattering material particles have been deposited, characterized in that an alkyl derivative of cellulose is sorbed to the fibrils.

2. The filler according to claim 1, characterized in that it comprises cellulose or lignocellulose fibrils prepared from vegetable fibers by beating and, when so desired, screening, the average thickness of the fibrils being smaller than 5 μm.

3. The filler according to claim 2, characterized in that the alkyl derivative of cellulose is sorbed into fibrils corresponding to a fraction passing a 50 mesh screen and/or having an average thickness of 0.01–5 μm and an average length of 10–1500 μm.

4. The filler according to claim 1, characterized in that the light-scattering material particles are inorganic or organic salts which can be formed from their source materials by precipitation in an aqueous medium.

5. The filler according to claim 4, characterized in that the light-scattering material particles are calcium carbonate, calcium oxalate, calcium sulfate, barium sulfate, or a mixture thereof.

6. The filler according to claim 1, characterized in that the material particles are deposited on the fibrils in order to produce a string-of-pearls-like aggregate.

7. The filler according to claim 1, characterized in that the alkyl derivative of cellulose is carboxymethyl cellulose, carboxyethyl cellulose, methyl cellulose, ethyl cellulose, or ether derivatives thereof.

8. The filler according to claim 7, characterized in that the alkyl derivative of cellulose is carboxymethyl cellulose having a DS of 0.1–1.2, preferably approx. 0.4–0.9.

9. The filler according to claim 1, characterized in that the quantity of the light-scattering material particles in proportion to the quantity of fibrils is 0.0001–95% by weight, preferably approx. 0.1–90% by weight, most suitably approx. 60–80% by weight, calculated from the quantity of filler, and the quantity of the alkyl derivative of cellulose in proportion to the quantity of fibrils is approx. 0.1–30% by weight, preferably approx. 1–20% by weight, calculated from the fines in the filler.

10. A process for preparing a filler, according to which process light-scattering material particles are deposited on cellulose or lignocellulose fibrils in an aqueous medium, characterized in that an alkyl derivative of cellulose is added to the medium and is allowed to become sorbed into the fibrils in the filler.

11. The process according to claim 10, characterized by preparing a fibril suspension from a source material containing cellulose fibrils or lignocellulose fibrils, feeding into the fibril suspension source materials forming an inorganic salt which, upon precipitating, forms a light-scattering pigment, allowing the precipitating, light-scattering pigment to attach to the fibrils, mixing, at a selected stage, with the fibril suspension an alkyl derivative of cellulose which is at least partly in a form dissolved in water, and allowing the derivative to attach to the fibrils.

12. The process according to claim 10, characterized in that the alkyl derivative of cellulose used is carboxymethyl cellulose, carboxyethyl cellulose, methyl cellulose, ethyl cellulose, or ether derivatives thereof.

13. The process according to claim 12, characterized in that the alkyl derivative of cellulose is carboxymethyl cellulose which has a degree of substitution of 0.1–1.2, most suitably 0.4–0.9, and is dissolved in water or an alkali solution.

14. The process according to claim 10, characterized by allowing the alkyl derivative of cellulose to attach to the cellulose and/or lignocellulose fibrils so that at least 10%, preferably at least 20%, and especially preferably at least 30%, of the derivative present in the aqueous phase attaches to the fibrils.

15. The process according to claim 10, characterized by feeding into the fibril suspension so large a quantity of the cellulose derivative that the amount of the alkyl derivative sorbing into the fibrils is 0.1–30%, preferably 1–20%, of the weight of the fibrils.

16. The process according to claim 10, characterized by maintaining the pH of the fibril suspension is maintained at 7 or at a higher value during the sorption of the alkyl derivative of cellulose.

17. The process according to claim 10, characterized by feeding into the fibril suspension an aqueous calcium hydroxide solution, which possibly contains solid calcium hydroxide, and an aqueous solution of a carbonate compound and/or gaseous carbon dioxide.

18. The process according to claim 10, characterized by sorbing the alkyl derivative of cellulose to the fibrils at the same time as light-scattering material particles are being attached to the fibrils by deposition, or by carrying out the sorption after the deposition of the light-scattering material particles.

19. The process according to claim 10, characterized by sorbing the alkyl derivative of cellulose to the fibrils before light-scattering material particles are attached to them by deposition.

20. The use of a filler according to claim 1 for making of paper having good wet strength.

* * * * *